United States Patent [19]

Hager

[11] 4,143,607

[45] Mar. 13, 1979

[54] SEWING MACHINE WITH DIFFERENTIAL WORK TRANSPORT

[75] Inventor: Walter Hager, Kaiserslautern, Fed. Rep. of Germany

[73] Assignee: Pfaff Industriemaschinen GmbH, Kaiserslautern, Fed. Rep. of Germany

[21] Appl. No.: 795,028

[22] Filed: May 9, 1977

[30] Foreign Application Priority Data

Jun. 4, 1976 [DE] Fed. Rep. of Germany ..... 2625152

[51] Int. Cl.[2] ..... D05B 27/08

[52] U.S. Cl. ..... 112/209; 112/212; 226/32

[58] Field of Search ..... 112/209, 210, 208, 212, 112/207; 226/32, 88, 115, 195

[56] References Cited

U.S. PATENT DOCUMENTS

| | | | |
|---|---|---|---|
| 3,174,449 | 3/1965 | Bono | 112/209 |
| 3,198,153 | 8/1965 | Weber | 112/209 |
| 3,202,121 | 8/1965 | Orth et al. | 112/209 |
| 3,368,507 | 2/1968 | Orth | 112/209 |
| 3,970,018 | 7/1976 | Hager | 112/209 X |

*Primary Examiner*—Werner H. Schroeder
*Attorney, Agent, or Firm*—McGlew and Tuttle

[57] ABSTRACT

The sewing machine has a differential work transport, consisting of a lower main feed and lower and upper auxiliary feeds, with the step sizes of the auxiliary feeds being adjustable, from a step size substantially in accordance with the step size of the main feed, against spring bias. The step sizes are adjusted by respective setting devices having associated setting members connected, through a lever drive, to a common actuating device. The lever drive interconnecting the setting members of the setting devices for the lower and upper auxiliary feeds is operable to vary the step sizes of the lower and upper auxiliary feeds so that one of said lower and upper auxiliary feeds increases as the other of said lower and upper auxiliary feeds decreases. The transmission ratio of the lever drive is adjustable, and the lever drive includes a driver connection operative in one direction only.

5 Claims, 2 Drawing Figures

SEWING MACHINE WITH DIFFERENTIAL WORK TRANSPORT

FIELD AND BACKGROUND OF THE INVENTION

This invention relates to a sewing machine with a differential work transport, consisting of a lower main feed and lower and upper auxiliary feeds, with the step sizes of the auxiliary feeds being adjustable from the step size substantially concording with that of the main feed, against spring bias, by setting devices whose setting members are connected, through a lever drive, with a common actuating means.

DESCRIPTION OF THE PRIOR ART

Sewing machines of this type, known up to now, require, for the shirring or gathering of stiff sewing material, an intermediate plate between the ply to be gathered and the ply which is not to be gathered, because the two superposed plies do not slide sufficiently on each other without the use of such an intermediate plate. This is due to their mutual friction and, therefore, an insufficient gathering effect is obtained. However, even with the intermediate plate, sufficient gathering of one fabric ply relative to the other fabric ply cannot be attained as soon as the ply to be gathered falls short of a certain flexibility. Besides, the pivoting in and out of the intermediate plate, which is necessary for closed seams, slows up the operation to be executed.

SUMMARY OF THE INVENTION

The objective of the present invention is to improve the known differential sewing machines so that, even when operating with relatively stiff fabric plies, for example when sewing the fabric inner sole into textile shoe uppers, sufficient gathering of one ply relative to the other ply can be carried out without using an intermediate plate.

To this end, the sewing machine of the present invention is designed with a differential work transport whereby the two auxiliary feeds exert, during the gathering process, a very large magnitude differential action on the superposed plies. In accordance with the present invention, this problem is solved in a surprisingly simple manner by designing a lever drive, disposed between the setting members of the setting devices for the two auxiliary feeds, operable to vary the respective step sizes of the two auxiliary feeds so that one of said lower and upper auxiliary feeds increases as the other of said lower and upper auxiliary feeds decreases.

Advantageously, the transmission ratio of the lever drive is adjustable so that optimum gathering ratios thus can be set at different step sizes of the main feed.

In order to be able to use the arrangement embodying the invention on a sewing machine wherein the setting members of the setting devices for the two auxiliary feeds are coupled, by respective force-locking couplings, with the adjusting member of the setting device for the main feed, which is connected with a shifting handle, the lever drive comprises a driver connection acting in only one direction. Consequently, this driver connection is effective only upon variation of the step sizes of the auxiliary feeds relative to the step size of the main feed. In machines where the step sizes of the auxiliary feeds automatically readjust themselves to the step size of the main feed in normal sewing, the contrasting problem, of being able to vary the step size of the auxiliary feeds when gathering in different directions, is solved in this manner.

An object of the invention is to provide an improved sewing machine with a differential work transport consisting of a lower main feed and lower and upper auxiliary feeds whose step sizes are adjustable from the step size substantially concording with the main feed against the spring bias by setting devices whose setting members are connected with a common actuating means to a lever drive.

Another object of the invention is to provide such a sewing machine which does not require an intermediate plate to be interposed between two plies which are to be gathered relative to each other.

A further object of the invention is to provide an improved differential sewing machine in which relatively stiff fabric plies can be sufficiently gathered, relative to each other, without the use of an intermediate plate.

Yet another object of the invention is to provide a sewing machine with such a differential work transport in which the two auxiliary feeds exert, during the gathering process, a very large magnitude differential action on the superposed plies.

A further object of the invention is to provide such a sewing machine, with a differential work transport, in which a lever drive, disposed between the setting members of the setting devices for the two auxiliary feeds, varies the respective step sizes of the two auxiliary feeds so that one of said lower and upper auxiliary feeds increases as the other of said lower and upper auxiliary feeds decreases.

For an understanding of the principles of the invention, reference is made to the following description of a typical embodiment thereof as illustrated in the accompanying drawings.

DESCRIPTION OF THE PREFERRED EMBODIMENT

Figure 2:
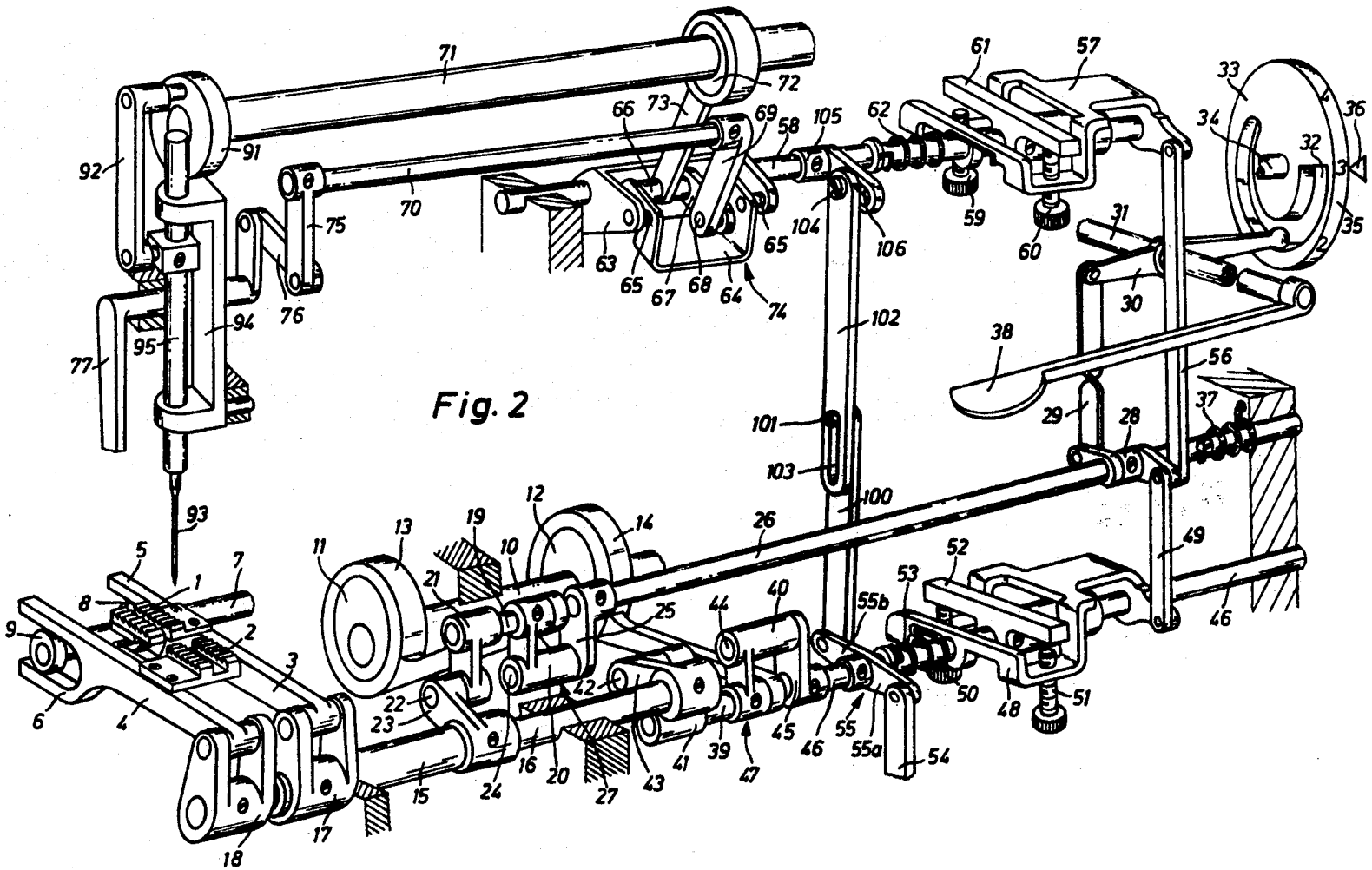
FIG. 2 is a perspective view of the drive mechanism for the feed tools of the sewing machine.

Referring first to FIG. 2, the sewing machine embodying the invention comprises a main feed 1, which is a lower feed, and a lower auxiliary feed 2, which are carried by respective supports 3 and 4. Supports 3 and 4 are formed with respective fork-type ends 5 and 6, each having extending thereinto, a respective eccentric 8, 9, secured on a shaft 7. Shaft 7 is driven in the usual manner, not shown, to impart lifting movements to the feeds 1 and 2.

Another shaft 10, in driving connection with shaft 7, is rotatably mounted to extend parallel to shaft 7, and has secured thereon eccentrics 11 and 12 embraced by respective eccentric rods or links 13 and 14.

Two coaxial shafts 15 and 16 are mounted parallel and in spaced relation to shaft 10, with the inner shaft 16 protruding from the outer shaft 15. A fork-type lever 17 is firmly connected with shaft 15, and support 3 for main feed 1 is articulated to lever 17. Similarly, a fork-type lever 18 is firmly connected to shaft 16, and support 4, for the lower auxiliary feed 2, is articulated to lever 18.

The free end of eccentric rod 13 is articulated to a stud 19 which is firmly secured to a link 20 and is rotatably engaged in a link 21. Link 21 is articulated, by means of a journal 22, to a lever 23 having its hub secured on shaft 15, while link 20 is articulated, by means of a journal 24, with a lever 25 which is secured on a setting shaft 26. Parts 19 through 26 form a setting device 27 for setting the step size of the main feed 1, with lever 25 and links 20 and 21 having the same effective length.

A double lever 28 is secured on setting shaft 26 and is connected, through a link 29, with one arm of a lever 30. Lever 30 is secured on a shaft 31 mounted in the housing of the sewing machine, and its other arm is engaged in a groove 32 of a setting disc 33 which is secured on a shaft 34 also mounted rotatably in the housing of the sewing machine. Setting disc 33 cooperates with a setting mark 36 conveniently provided on the housing of the sewing machine.

A spiral spring 37 is secured at one end to the housing of the sewing machine and at its other end with setting shaft 26, so as to effect a rotation of setting shaft 26 in a direction until lever 30 strikes against the outer wall of the grooves 32 so that main feed 1 shifts the work in the forward direction and in accordance with the value on scale 35 opposite setting mark 36. To reverse the main feed direction, a key lever 38 is fixed on shaft 31 at its end protruding from the sewing machine housing.

The free end of eccentric rod 14 is articulated to a stud 39 firmly connected with a link 40 and rotatably engaged in a link 41. Link 41 is articulated, by means of a journal 42, to a lever 43 whose hub is secured to shaft 16, while link 40 is articulated, by means of a journal 44, with a lever 45 which is secured on a setting shaft 46. Parts 39 through 46 form a setting device 47 for setting the step size of the lower auxiliary feed 2, with lever 45 and links 40 and 41 having the same effective length.

A bridge 48 is oscillatably mounted on setting shaft 46, and is connected, through a connecting rod 49, with double lever 28. With this arrangement, bridge 48, due to connecting rod 49 and double lever 28, is rotated through the same angular extent as setting shaft 26 is rotated.

In order to be able to adjust setting shaft 46 for variation of the step size of the lower auxiliary feed 2 relative to that of the main feed 1, setting screws 50 and 51 are threaded into bridge 48 and cooperate with a two-arm abutment piece 52 secured on setting shaft 46. A spiral spring 53 embraces setting shaft 46, and is secured at one end to bridge 48 and at its other end to setting shaft 46. Spring 53 rotates abutment piece 52 in a direction such that one arm thereof makes contact on setting screw 50.

By means of a foot pedal, which has not been shown, setting shaft 46 can be rotated through a connecting rod 54 articulated to an arm **55*a* of a double-lever 55 secured on setting shaft 46, until abutment piece 52 contacts setting screw 51**.

A connecting rod 56 connects double-lever 28 with a bridge 57 which is oscillatably mounted on a setting shaft 58. To be able also to vary the angular position of setting shaft 58 relative to the angular position of setting shaft 26, two setting screws 59 and 60 are threaded into bridge 57 and cooperate with a two-arm abutment piece 61 secured on setting shaft 58. A spiral spring 62 embraces setting shaft 58, and has one end secured to setting shaft 58 and the other end secured to bridge 57. Spring 62 tends to rotate abutment piece 61 so that one arm thereof contacts setting screw 60.

Setting shaft 58 is connected with a channel-shape bracket 63 between whose arms another channel-shape bracket 64 is rotatably mounted by means of journals 65. The arms of bracket 64 are connected by a stud 66 secured to a link 67. Link 67 is articulated, by means of a journal 68, to a lever arm 69 secured to one end of a rocking shaft 70 mounted in the housing of the sewing machine. An eccentric 72, which is secured on an arm shaft 71 mounted in the sewing machine housing to extend parallel to rocking shaft 70, and which is embraced by an eccentric rod 73, imparts swinging movements to stud 66 about the journals 65. Parts 58 and 63 through 69 form a setting device 74, with lever arm 69 and the effective lever arms of brackets 63 and 64 having the same effective length.

Figure 1:
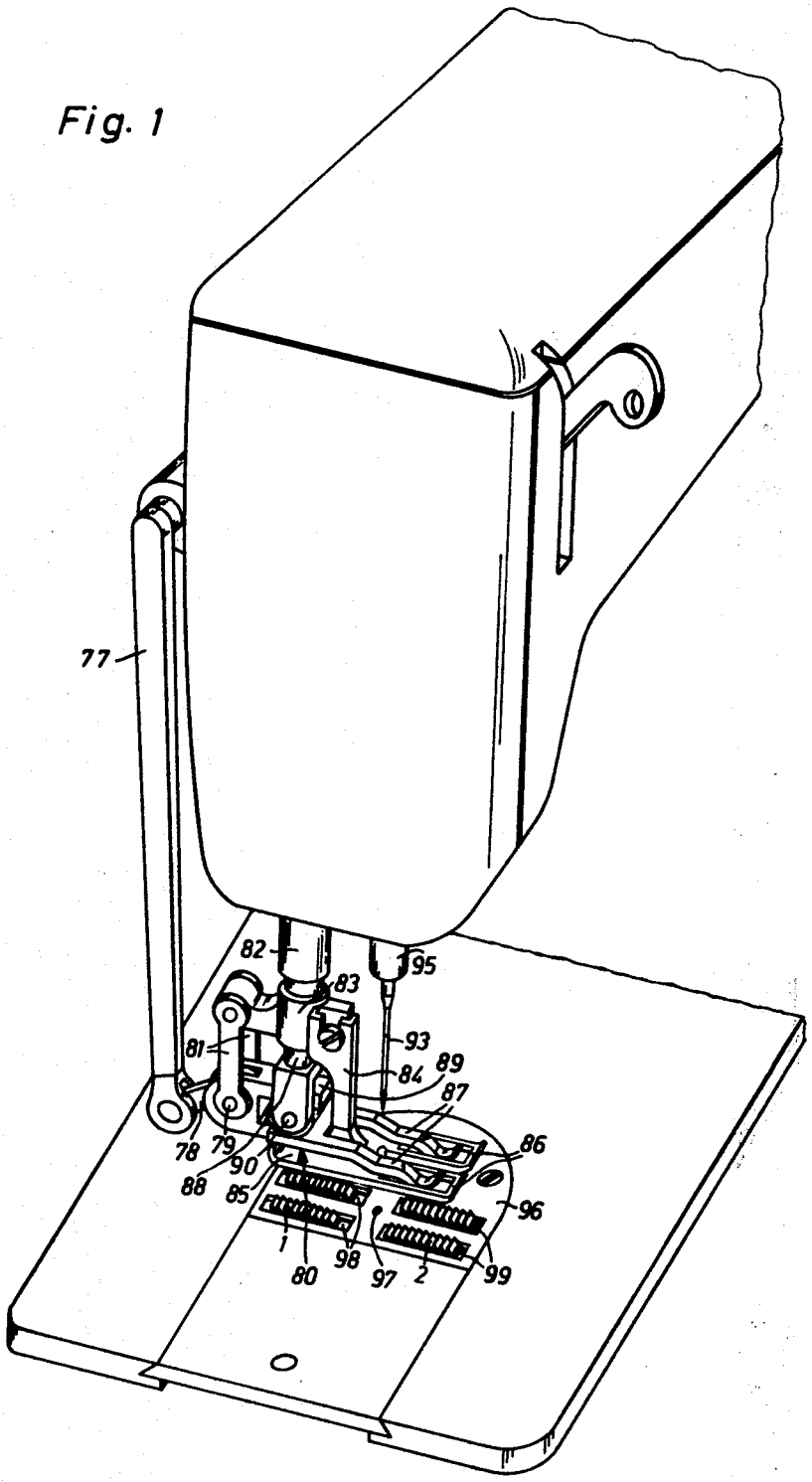
FIG. 1 is a perspective view of the head of a sewing machine embodying the invention, illustrating the stitch-forming point and the upper sewing tools.

A lever arm 75 is secured to the other end of oscillatable shaft 70 and is connected, through a link 76, with one arm of a double-arm lever 77 also oscillatably mounted in the housing. Referring to FIG. 1, the other arm of lever 77 is pivotally connected with a link 78 connected, by a journal 79, with an upper auxiliary feed 80. Auxiliary feed 80 is supported by a pair of links 81 articulated to a support 83 secured to a presser bar 82 of known design. A presser foot 84 is also secured to support 83 and has a sole 85 cooperating with main feed 1 and lower auxiliary feed 2, sole 85 having cutouts 86 for the passage of toes 87 of auxiliary feed 80 engaging the work.

A bar 88 is mounted in the tubular presser bar 82 and has, at its lower end, a journal 90 engaging in a fork 89 of upper auxiliary feed 80. Bar 88 is reciprocated up and down in an axial direction in a known manner, for the execution of lift movements for upper auxiliary feed 80.

A crank 91, secured on arm shaft 71 shown in FIG. 2, is in operative connection, through a link 92, with a needle bar 95 carrying a needle 93 and mounted in a guideway 94. As best seen in FIG. 1, needle 93 cooperates, through a stitch hole 97, with a looper which has not been shown and which is driven under stitch plate 96 in a known manner. Respective slots 98 and 99 for the passage of main feed 1 and lower auxiliary feed 2, are provided in stitch plate 96 before and behind the stitch hole 97. Feeds 1, 2 and 80 are so arranged that main feed 1 engages the work with the sole 85 of presser foot 84 behind stitch hole 97, seen in the sewing direction, while the auxiliary feeds 2 and 80 engage the work in advance of stitch hole 97.

A bar 100 is articulated on the second arm **55*b* of lever 55 secured on setting shaft 46, and is connected, by a trunnion screw 101, with another bar 102. Trunnion screw 101 is guided in a slot 103 in bar 102. Bar 102 is articulated, by means of a collar screw 104 to a lever arm 105 secured on setting shaft 58, and which extends in a direction opposite to the extent of arm 55*b*. To vary the effective length of lever arm 105, collar screw 104 can be adjusted inside a slot 106 in lever arm 105**.

OPERATION OF THE DIFFERENTIAL WORK TRANSPORT DEVICE

The work transport device operates in a manner which will now be described. The variation of the step size of main feed 1 is effected by rotating setting disc 33 so that, under the bias of spiral spring 37, setting shaft 26 also rotates until lever 30, which is articulatedly connected with setting shaft 26, contacts that wall of groove 32 of setting disc 33 engaged for the forward stroke of the work transport.

During its rotation, setting shaft 26 rotates lever 25 and thus displaces journal 24, serving as the axis of rotation for link 20, relative to journal 22. During the swinging out movement of stud 19 by eccentric rod 13, link 20 consequently executes a pure rotary movement around journal 24, whereas link 21 executes, in addition to this rotary movement, a relative motion about the axis of shaft 15. This relative motion is transmitted by lever 23, as a swinging motion, to lever 17, which imparts speed movements to main feed 1 through support 3. The magnitude of these feed movements depends on the position of setting disc 33, and hence on the magnitude of the displacement difference between journals 22 and 24. The magnitude can be read on scale 35 with the aid of setting mark 36.

Responsive to the displacement of setting shaft 26, the angular position of bridge 48 changes, in the same amount, through the connecting rod 49. As bridge 48 is rotated, setting screw 50 rotates abutment piece 52, so that setting shaft 46, fixedly connected with abutment piece 52, is rotated through the same angle as that through which setting shaft 26 is rotated.

Lever 45, fixed on setting shaft 46, pivots link 40 so that journal 44, serving as the axis of rotation for link 40, is displaced relative to journal 42. During the swinging-out movement of stud 39 by eccentric rod 14, and in analogy to the above-described setting device 27, link 40 executes a pure rotary movement around journal 44, whereas link 41 executes, in addition, a relative motion about the axis of shaft 16 and thus imparts swinging movements to the latter through the lever arm 43. These swinging movements are transmitted by shaft 16, through lever 18 and support 4, to the lower auxiliary feed 2, as feed movements.

Also synchronously with the angular adjustment of setting shaft 26, the angular position of bridge 57 is changed due to its coupling to shaft 26 through connecting rod 56 and double-lever 28. Spiral spring 62 holds abutment piece 61 in contact with setting screw 60, so that setting shaft 58 is also rotated by the same angular amount. Setting shaft 58 rotates bracket 63 and, in so doing, displaces bracket 64, so that journals 65 are displaced relative to journals 68. During the swinging-out movement of stud 66 by eccentric rod 73, bracket 64 consequently executes swinging movements around the axis of shaft 70 in addition to a rotary movement around the axis of journal 65, for the reasons mentioned in the description of the operation of setting device 27. These movements are transmitted to upper auxiliary feed 80, as feed movements, through lever arm 75, link 76, lever 77 and link 78 (FIG. 1).

The adjustment of setting screw 50 in bridge 48, as well as the adjustment of setting screw 60 in bridge 57, is so chosen that, in normal sewing, the step length of the two auxiliary feeds 2 and 80 is exactly the same as the step length of the main feed 1, that is, the feed value set on scale 35 by reference to mark 36 is executed by all three feeds 1, 2 and 80. In such case, two fabric plies lying between stitch plate 96 and sole 85 of presser foot 84 are sewn in the normal manner without mutual gathering.

To gather the lower fabric ply relative to the upper fabric ply, the operator actuates the pedal (not shown) whereby, double lever 55 rotates setting shaft 46, through connecting rod 54 and against the bias of spiral spring 53, until setting screw 51 contacts abutment piece 52. Setting shaft 46 rotates lever 45, with journal 44 being still further displaced relative to journal 42, and stud 39, swinging out constantly through eccentric rod 14 imparting to lever 43, through link 41, an increased swinging-out movement. Thereby, the step size of lower feed 2 increases relative to the step size of main feed 1 by the value set at setting screw 51.

Simultaneously with such rotation of setting shaft 46, setting shaft 58 is also rotated through bars 100 and 102 and lever arm 105, against the bias of spiral spring 62. Setting shaft 58 rotates bracket 63, so that journals 65 are displaced toward journal 68. During the constant swinging-out of stud 66 by eccentric rod 73, smaller swinging-out movements consequently are imparted to lever arm 69 than were imparted before. Thereby, also the step size of upper auxiliary feed 80 is reduced to zero when the step size of lower auxiliary feed 2 has reached its maximum set size. This mutual displacement ratio results in a maximum of gathering effect.

During the gathering, the upper fabric ply is not only stretched by the reduced feed movement of upper auxiliary feed 80, but is also decelerated very strongly relative to the lower fabric ply transported with the increased feed movement of the lower feed. Although the upper ply transported more slowly rests on the lower ply under pressure, frictional entrainment by the lower ply is ruled out by this arrangement. Consequently, with the differential work transport of the present invention, very large magnitude gathering effects can be obtained also on relatively stiff materials.

While the setting screws 50 and 60 of the respective bridges 48 and 57 form the abutments for that position of setting devices 47 and 74 at which auxiliary feeds 2 and 80 execute the same step sizes as main feed 1, that is, at which no gathering of the plies takes place, setting screw 51 of bridge 48 forms the abutment for that position of the two setting devices 47 and 74 at which the maximum gathering effect, as desired by the operator, of the two auxiliary feeds 2 and 80, relative to main feed 1, appears. Between these two positions, it is possible, by appropriate setting of the screws 50 and 60 as well as the screw 51, to set any desired end positions for the gathering effect of the two auxiliary feeds 2 and 80 relative to main feed 1.

To lock the seam at the beginning or at the end, the operator actuates key lever 38 against the bias of spiral spring 37, whereby setting shaft 26 and, through connecting rods 49 and 56, also setting shafts 46 and 48, are rotated so that the setting devices 27, 47 and 74 reverse the feed direction for the main feed 1 and the two auxiliary feeds 2 and 80. In such operation, the end of lever 30 engages the inner wall of the groove 32 in setting disc 33.

The dimension of slot 103 in bar 102 is so selected that, at the maximum step size of main feed 1, of about 4 mm, the trunnion screw 101 just strikes against the upper limiting wall of slot 103, and that, upon reversal of the feed direction by actuation of key 38, the effective total length of the two bars 100 and 102 can increase to the extent that the transport stroke of feeds 1, 2 and 80 is not impaired in the backward sewing direction.

While a specific embodiment of the invention has been shown and described in detail to illustrate the application of the principles of the invention, it will be understood that the invention may be embodied otherwise without departing from such principles.

What is claimed is:

1. In a sewing machine with a differential work transport, consisting of a lower main feed and lower and upper auxiliary feeds, with the step sizes of the auxiliary feeds being adjustable, from a step size substantially in accordance with the step size of the main feed, against the bias of springs, by respective setting devices having associated setting members connected through a lever drive to a common actuating means, the improvement comprising said lever drive interconnecting said setting members of the respective setting devices for said lower and upper auxiliary feeds and being operable to simultaneously vary the step size of said lower and upper auxiliary feeds so that one of said lower and upper auxiliary feeds increases as the other of said lower and upper auxiliary feeds decreases in response to operation of said actuating means.

2. In a sewing machine with a differential work transport, the improvement claimed in claim 1, in which the transmission ratio of said lever drive is adjustable.

3. In a sewing machine with a differential work transport, the improvement claimed in claim 1, including a setting device for the main feed having an associated setting member; respective force couplings connecting the setting members of the setting devices for the lower and upper auxiliary feeds to the setting member of the setting device for the main feed; a shifting handle; a force coupling connecting the setting member of the setting device for the main feed with said shifting handle; and said lever drive including a driver connection operative in one direction only.

4. In a sewing machine with a differential work transport, the improvement claimed in claim 1, including respective setting means operable to adjust the effective step lengths of said lower and upper auxiliary feeds.

5. In a sewing machine with a differential work transport, the improvement claimed in claim 4, in which said setting means includes a setting means operable to adjust the position of both setting devices, of the lower and upper auxiliary feeds, for the maximum gathering effect on the work pieces.

* * * * *